US007607644B1

(12) United States Patent
Gibb et al.

(10) Patent No.: US 7,607,644 B1
(45) Date of Patent: Oct. 27, 2009

(54) BOAT LIFT ASSEMBLY

(75) Inventors: James Carson Gibb, Windsor (CA); William Steven Szekesy, Belle River (CA)

(73) Assignee: Acculift, Inc., Melvindale, MI (US)

( * ) Notice: Subject to any disclaimer, the term of this patent is extended or adjusted under 35 U.S.C. 154(b) by 67 days.

(21) Appl. No.: 12/135,528

(22) Filed: Jun. 9, 2008

(51) Int. Cl.
*B66D 3/00* (2006.01)

(52) U.S. Cl. ..... 254/383; 254/333

(58) Field of Classification Search ..... 254/333, 254/383

See application file for complete search history.

(56) References Cited

U.S. PATENT DOCUMENTS

| | | | | | |
|---|---|---|---|---|---|
| 2,240,523 | A * | 5/1941 | Schramm | 254/362 |
| 2,549,172 | A * | 4/1951 | Cline | 254/278 |
| 3,614,067 | A * | 10/1971 | Vermette | 242/370 |
| 3,843,094 | A * | 10/1974 | Watts | 254/333 |
| 3,887,164 | A * | 6/1975 | Coombs | 254/296 |
| 4,953,829 | A * | 9/1990 | Knaack et al. | 254/333 |
| 5,129,626 | A * | 7/1992 | Koludzki | 254/333 |
| 5,402,985 | A * | 4/1995 | Owens et al. | 254/333 |
| 5,669,575 | A * | 9/1997 | Byle | 242/470 |
| 5,988,941 | A | 11/1999 | Sargent et al. | |
| 6,098,962 | A * | 8/2000 | Henly | 254/333 |
| 6,122,994 | A | 9/2000 | Norfolk et al. | |
| 6,247,680 | B1 * | 6/2001 | Cohen | 254/333 |
| 6,935,807 | B2 | 8/2005 | Becker | |
| 7,104,492 | B1 * | 9/2006 | Massell et al. | 242/397 |
| 7,178,637 | B2 * | 2/2007 | Asano et al. | 187/254 |
| 7,226,041 | B2 | 6/2007 | Ledford | |

* cited by examiner

*Primary Examiner*—Emmanuel M Marcelo
(74) *Attorney, Agent, or Firm*—Robert K. Roth; Miller, Canfield, Paddock and Stone

(57) ABSTRACT

A boat lift assembly comprises a winch, a cable wrapped around the winch and adapted to be attached to the platform, wherein rotation of the winch in a first direction urges the cable to wrap further around the winch, and rotation of the winch in a second direction urges the cable to unwrap around the winch, and a cable retainer comprising a first bracket and a second bracket. A gap separates the cable from the cable retainer when the cable is taut around the winch, and when the cable is slack the cable is restricted from movement away from the winch by the cable retainer.

6 Claims, 3 Drawing Sheets

BOAT LIFT ASSEMBLY

FIELD OF THE INVENTION

This invention relates to improvements in boat lift assemblies, and more particularly, to boat lift assemblies with improved cable retainers which do not require modifications to the cables and to the windings to function properly.

BACKGROUND OF THE INVENTION

Boats may be lowered into water using a boat lift assembly. Typically such a boat lift assembly comprises one or more winches. At least one cable wraps around each winch and connects the winches to a platform. The boat can be positioned over the platform. Rotation of the winches moves the cables, and the cables in turn move the platform and carry the boat up and down.

Preferably the cable should wind around the winch without crossing or tangling. This is accomplished by cable tension. Most known manufacturers of boat lift assemblies use what are known as scrubbers to help maintain cable tension. Scrubbers are a piece of rubber or plastic mounted on a plate and pressed against the cable. However, these parts wear out quickly and require lots of maintenance and repair, with attendant costs. U.S. Pat. No. 5,988,941 to Sargent et al discloses a similar concept where a boat lift cable lock apparatus provides a mounting bracket for defining a tapered cable channel. The tapered channel engages the cable to produces a friction lock helping to maintain tension in the cable. However, friction is a high variable phenomena, subject to the vagaries of materials, age, temperature and other environmental considerations. U.S. Pat. No. 6,935,807 to Becker discloses a weight attached to the cable which maintains tension on the cable to keep the cable from damaging a boatlift or a boat. However, adding a weight and/or springs drives up the costs and complexity of a boat lift assembly, and in some designs use of a weight is not practical. It would be desirable to provide a boat lift assembly which reduces the likelihood of uncontrolled movement of the cable and which increases the operating life of the cable.

SUMMARY OF THE INVENTION

In accordance with a first aspect, a boat lift assembly comprises a winch, a cable wrapped around the winch and adapted to be attached to the platform, wherein rotation of the winch in a first direction urges the cable to wrap further around the winch, and rotation of the winch in a second direction urges the cable to unwrap around the winch, and a cable retainer comprising a first bracket and a second bracket. A gap separates the cable from the cable retainer when the cable is taut around the winch, and when the cable is slack the cable is restricted from movement away from the winch by the cable retainer.

From the foregoing disclosure and the following more detailed description of various preferred embodiments it will be apparent to those skilled in the art that the present invention provides a significant advance in the technology of boat lift assemblies. Particularly significant in this regard is the potential the invention affords for providing a high quality, low cost boat lift cable retainer which does not require modifications to existing cable windings. Additional features and advantages of various preferred embodiments will be better understood in view of the detailed description provided below.

Figure 1:
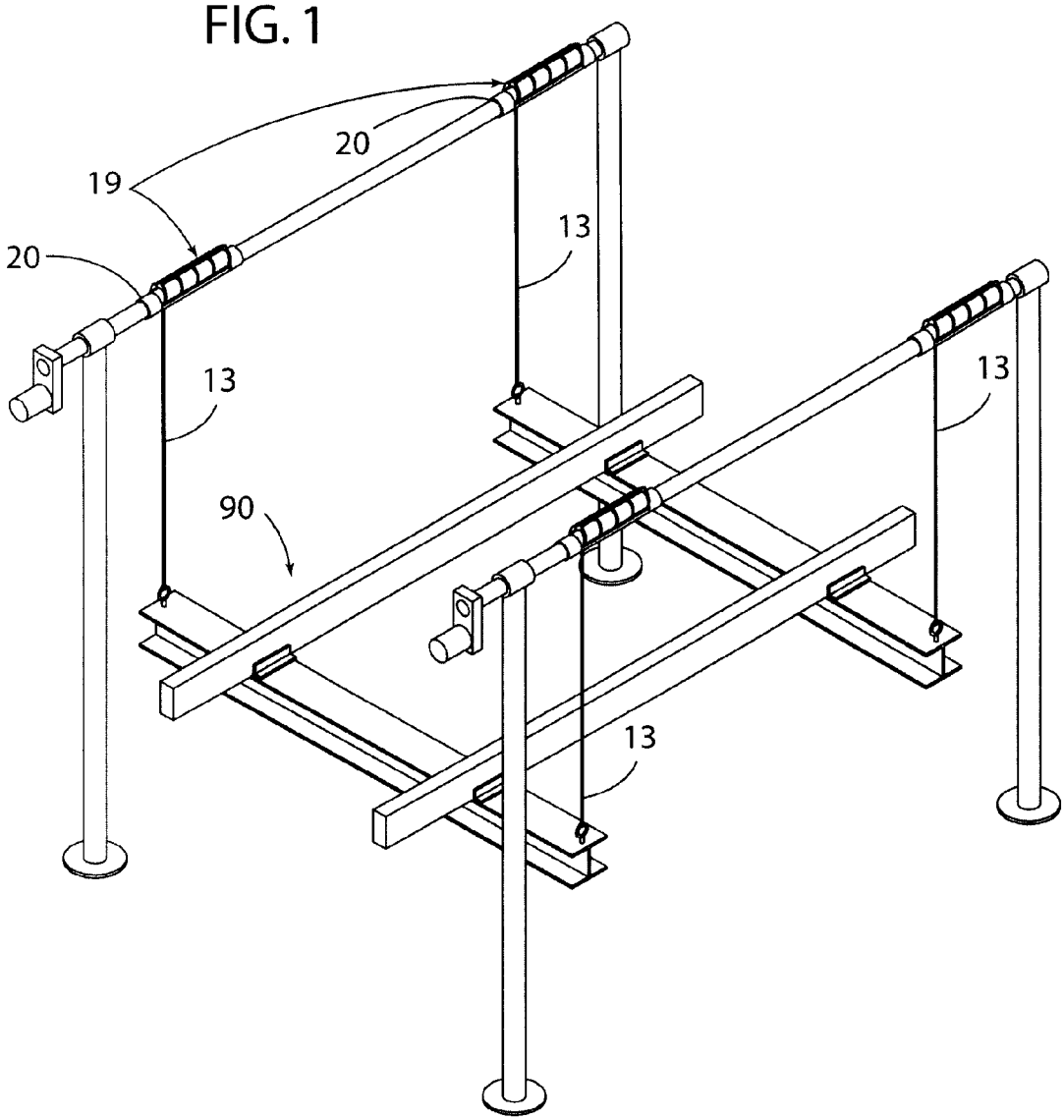
FIG. 1 is an isometric view of a boat lift assembly in accordance with a preferred embodiment

It should be understood that the appended drawings are not necessarily to scale, presenting a somewhat simplified representation of various preferred features illustrative of the basic principles of the invention. The specific design features of the boat lift assembly as disclosed here, including, for example, the specific dimensions of each bracket, will be determined in part by the particular intended application and use environment. Certain features of the illustrated embodiments have been enlarged or distorted relative to others to enhance visualization and clear understanding. In particular, thin features may be thickened, for example, for clarity of illustration. All references to direction and position, unless otherwise indicated, refer to the orientation illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved boat lift assembly disclosed here. The following detailed discussion of various alternative and preferred features and embodiments will illustrate the general principles of the invention with reference to a boat lift assembly particularly suitable for rapidly lifting boats out of water without fear of crossing or tangling the cables. Other embodiments suitable for other applications will be readily apparent to those skilled in the art given the benefit of this disclosure.

Figure 2:
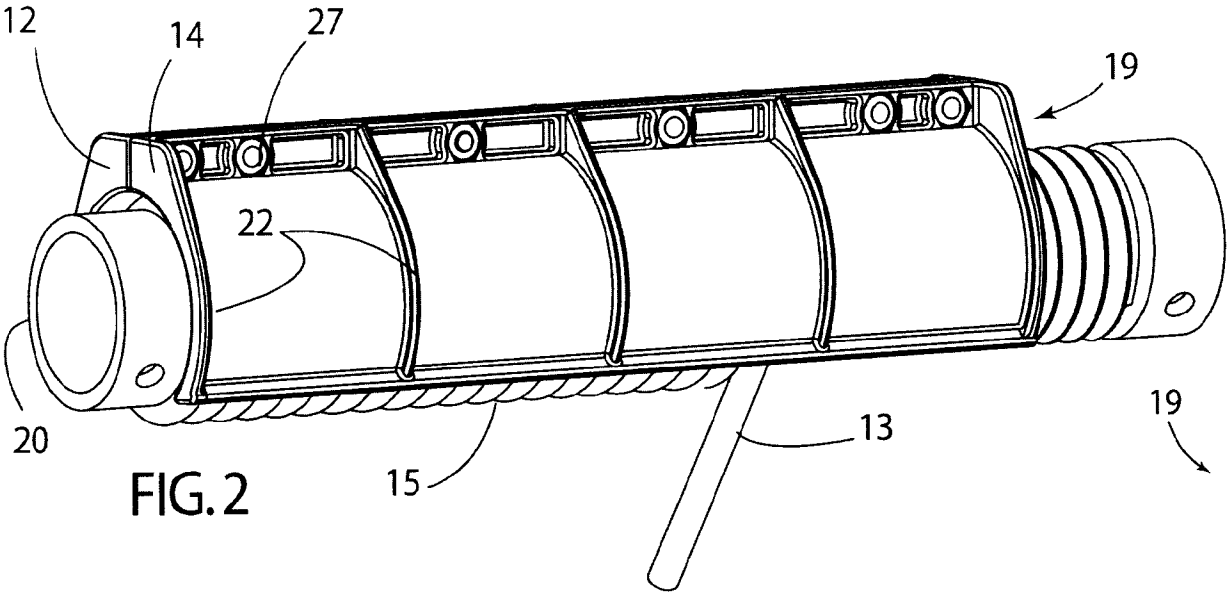
FIG. 2 is an isometric view of a winch with a cable retainer in accordance with the preferred embodiment of FIG. 1.
Figure 3:
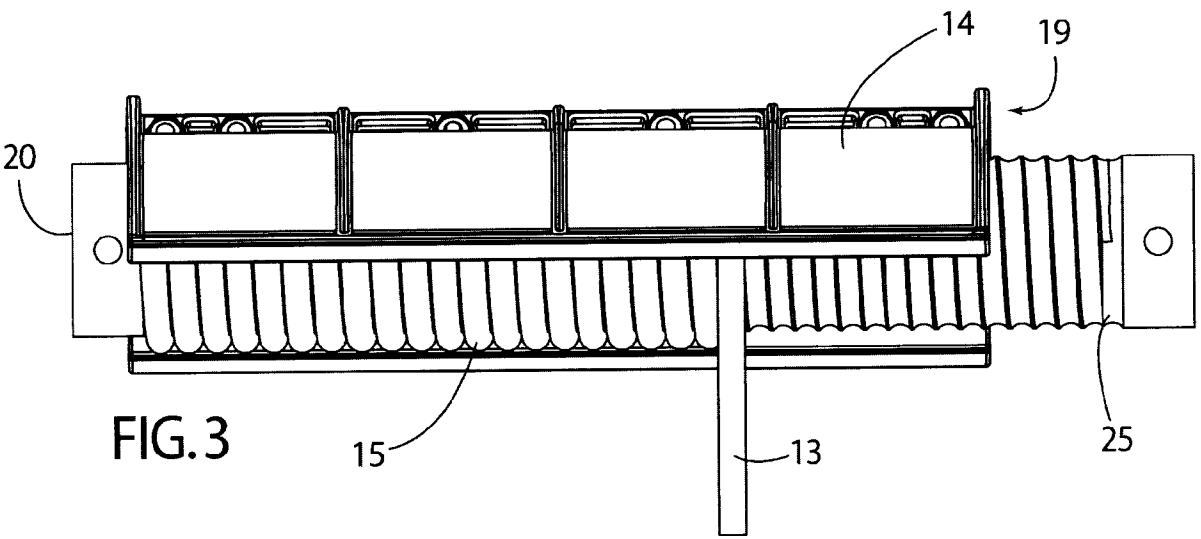
FIG. 3 is a side view of the cable retainer surrounding a cable wrapped around the winch.

Turning now to the drawings, FIG. 1 shows a boat lift assembly 10 in accordance with a preferred embodiment. A boat (not shown) may be positioned on a platform 90. Cables 13 connect the platform to winches 20. Rotation of the winches in a first direction pulls the cables up and wraps the cables around the winches. Rotation of the winches in a second direction opposite the first direction allows the weight of the platform to pull the cables down and unwraps the cables around the winches. FIGS. 2-3 show views of part of one of the winches 20. Optionally the winch 20 can be provided with a series of grooves 25 which receive a cable 13. Cable windings 15 are wrapped around the winch and are received in corresponding grooves 25. As shown in the Figs. the cable is in tension, wrapped taut around the winch.

In accordance with a highly advantageous feature, cable retainer 19 is provided which partially circumferentially surrounds the winch. Preferably cable retainer 19 comprises brackets 12, 14 each of which are semi-cylindrical in shape. As shown in the cross-section view of FIG. 5 and in FIG. 6, brackets 12 and 14 may be connected by a series of fasteners 27, such as bolts. The cable retainer 19 may be attached to a fixed surface (either a fixed part of the winch or a separate element) allowing the winch to rotate with respect to the cable retainer. FIG. 6 shows an isolated isometric view of the cable retainer 19. A series of reinforcing ribs 22 may be provided on each bracket. As best seen in FIG. 6, the ribs 22 extend circumferentially around each bracket and generally circumferentially with the winch. Preferably the brackets wrap partially around the winch, but, as shown in the Figs., not entirely around the winch. This allows room for the cable to wrap and unwrap around the winch and connect to the platform below. The bracket wraps at least 180 degrees and more preferably over about 200 degrees around the winch 20. In the preferred embodiment shown in the Figs. the brackets wrap around the winch about 240 degrees.

Figure 4:
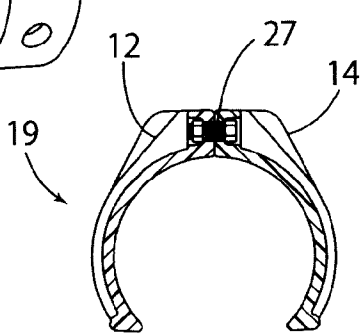
FIG. 4 is a cross section view of the winch and cable retainer of FIG. 3.

FIG. 4 shows a side view of the winch 20 and cable retainer 19. In accordance with a highly advantageous feature a small gap 99 exists between the cable retainer 19 and the cable wraps 15 of cable 13 when the cable is in its normal condition—that is, when the cable is taut around the winch. Advantageously, the cable retainer 19 does not interfere with ordinary movement of the cable during the process of raising and lowering a boat. However, when the cable goes slack, such as for example, when the boat is lowered and first hits the water, additional motion of the cable away from the winch is restricted by the cable retainer 19. In this manner cable retention and protection may be accomplished without continuously engaging the cable with a weight or a tapered bracket, etc.

Figure 5:
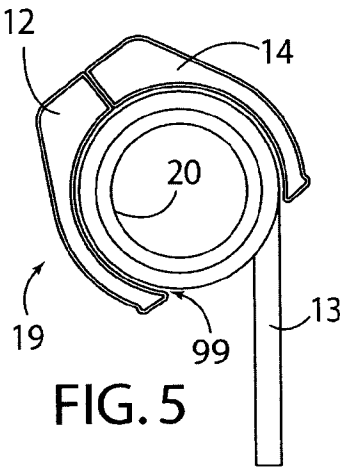
FIG. 5 is an end view of the cable retainer.
Figure 6:
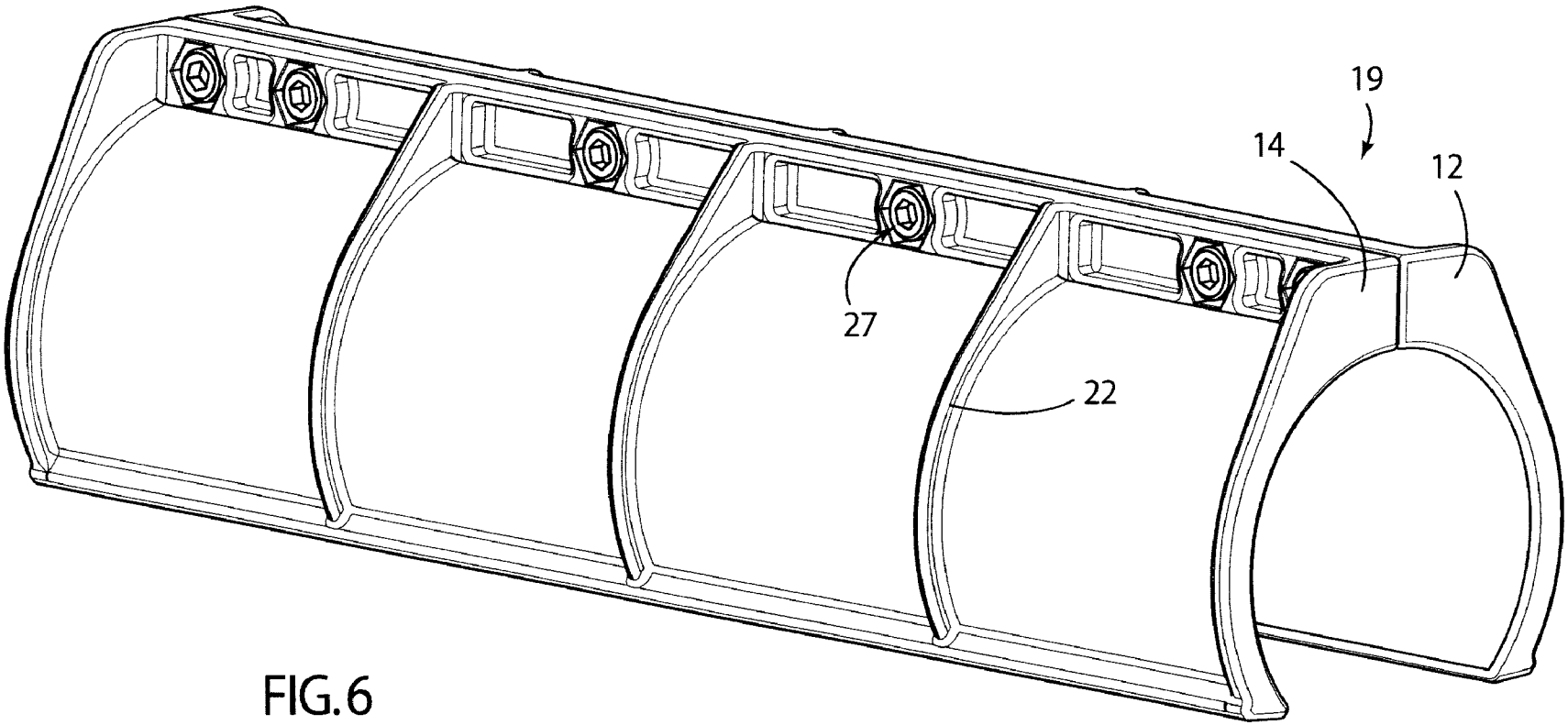
FIG. 6 is an isolated isometric view of the cable retainer.

FIG. 5 shows how the cable retainer 19 would be mounted with respect to the winch 20. Preferably the winch is positioned along a generally horizontal axis perpendicular to gravity and the cable retainer is offset from a vertical axis aligned with gravity by about 30-60 degrees, most preferably about 45 degrees. This allows the necessary space for the cable to unwind from the winch to the platform without continuously engaging the cable retainer. This clever and elegant solution to the problems associated with slack cables lends itself to ease in manufacturing and reduced costs and concerns for users.

The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A boat lift assembly for moving a platform carrying a boat comprising, in combination:

a winch;

a cable wrapped around the winch and adapted to be attached to the platform, wherein rotation of the winch in a first direction urges the cable to wrap further around the winch, and rotation of the winch in a second direction urges the cable to unwrap around the winch; and a cable retainer extending partially around the winch, the cable retainer mounted offset from a vertical axis by about 30-60 degrees, and the winch is mounted generally horizontally;

wherein a gap separates the cable from the cable retainer when the cable is taut around the winch, and when the cable is slack the cable is restricted from movement away from the winch by the cable retainer.

2. The boat lift assembly of claim 1 wherein the cable retainer comprises a first bracket and a second bracket connected together by a fastener.

3. The boat lift assembly of claim 2 wherein reinforcing ribs extend circumferentially along each bracket.

4. The boat lift assembly of claim 1 wherein the cable retainer extends at least 180 degrees around the winch.

5. The boat lift assembly of claim 4 wherein the cable retainer extends at least 210 degrees around the winch.

6. A boat lift assembly for moving a platform carrying a boat comprising, in combination:

a winch;

a cable wrapped around the winch and adapted to be attached to the platform, wherein rotation of the winch in a first direction urges the cable to wrap further around the winch, and rotation of the winch in a second direction urges the cable to unwrap around the winch; and a cable retainer extending partially around the winch comprising a first bracket and a second bracket connected together by a fastener, and reinforcing ribs extend circumferentially along each bracket;

wherein a gap separates the cable from the cable retainer when the cable is taut around the winch, and when the cable is slack the cable is restricted from movement away from the winch by the cable retainer.

* * * * *